US005549404A

United States Patent [19]

Kageyama et al.

[11] Patent Number: 5,549,404

[45] Date of Patent: Aug. 27, 1996

[54] STICK-SHAPED MATERIAL DRIVE CONTAINER AND SUPPLY CASSETTE

[75] Inventors: Shuhei Kageyama; Shoji Anzai; Yoshihide Mitsuya, all of Kawagoe, Japan

[73] Assignee: Kotobuki & Co., Ltd., Kyoto, Japan

[21] Appl. No.: 344,094

[22] Filed: Nov. 23, 1994

Related U.S. Application Data

[63] Continuation of Ser. No. 115,186, Aug. 31, 1993, abandoned.

[30] Foreign Application Priority Data

Mar. 29, 1993 [JP] Japan ..... 5-014839

[51] Int. Cl.[6] ..... A45D 40/06; A45D 40/16

[52] U.S. Cl. ..... 401/75; 401/76; 401/87; 401/98

[58] Field of Search ..... 401/75, 78, 87, 401/76, 86, 98

[56] References Cited

U.S. PATENT DOCUMENTS

| | | | |
|---|---|---|---|
| 2,545,444 | 3/1951 | Braselton | 401/86 X |
| 2,612,991 | 10/1952 | Braselton | 401/75 |
| 2,753,991 | 7/1956 | Sherman | 401/78 X |
| 2,983,370 | 5/1961 | Askvold | 401/78 |
| 3,232,276 | 2/1966 | Kupersmith et al. | 401/75 X |
| 3,380,795 | 4/1968 | Gruska | 401/78 |
| 3,706,354 | 12/1972 | Gruska | 401/78 |
| 5,018,892 | 5/1991 | Krueckel et al. | 401/75 X |

FOREIGN PATENT DOCUMENTS

| | | | |
|---|---|---|---|
| 1193220 | 10/1959 | France | 401/87 |

*Primary Examiner*—Steven A. Bratlie
*Attorney, Agent, or Firm*—David O'Reilly

[57] ABSTRACT

A stick-shaped piece drive container capable of preventing a stick-shaped piece from drying out by evaporating moisture is provided. A stick-shaped piece supplying cassette capable of supplying a stick-shaped piece to the stick-shaped piece drive container in a simple way is also provided. The stick-shaped piece drive container is comprised of an outer cylinder and a screw shaft having a helical groove provided on a circumference thereof and a non-rotatable connecting portion provided on a front end thereof, inserted in the outer cylinder movable in an axial direction thereof. An inner cylinder has a projection provided on a rear inside thereof that fits the helical groove, and is immovably mounted in the outer cylinder but is rotatable in an axial direction thereof to extend out of it forwardly. A stick-shaped piece holder is detachably coupled with the connecting portion of the screw shaft and slidably provided in the inner cylinder for holding a stick-shaped piece. A cap detachably fits the inner cylinder or the outer cylinder or both. A seal is provided on a circumference of the stick-shaped piece holder closely fitting the inside of the inner cylinder.

15 Claims, 6 Drawing Sheets

STICK-SHAPED MATERIAL DRIVE CONTAINER AND SUPPLY CASSETTE

This is a continuation of application Ser. No. 08/115,186 filed on Aug. 31, 1993 now abandoned.

BACKGROUND OF THE INVENTION

1. Field of the Invention

The present invention relates to a stick-shaped piece drive container and a stick-shaped piece supplying cassette. More particularly, it concerns a stick-shaped piece drive container which can selectively extend or retract a stick-shaped piece, such as a correction rod, a color stick, a stick-shaped paste, a stick-shaped rubber eraser, a lipstick, an eyebrow core, a pencil lead, and has a pass by rotation operation, and a stick-shaped piece supplying cassette which can supply the stick-shaped pieces to the driver container.

2. Background Information

FIG. 7 depicts a longitudinal cross-sectional view of one example of the construction of a conventional stick-shaped piece drive container.

In the figure, outer cylinder 21 has stick-shaped piece holder 24 provided there in which holds stick-shaped piece 23, such as, for example, a correction rod, with internal screw-thread 24A. Stick-shaped piece holder 24 is mounted for axial movement but is prevented from rotating by key 29 formed on an inside of outer cylinder 21 and keyway 30 formed on a circumference of stick-shaped piece holder 24.

Stick-shaped piece holder 24 also has internal screw-thread 35 formed on a rear inside thereof. Stick-shaped piece holder 24 further has screw shaft 36 provided therein which has screw groove 36A formed on a circumference thereof to engage internal screw-thread 35. Screw shaft 36 has annular ridge 37, annular ridge 38 on a large-diameter shaft and rear end knob 39 provided around its root, which are axially immovable but are axially rotatable and coupled with the inside of inward step 40, and annular groove 41 in a large-diameter cylinder of the rear end formed on the inside of outer cylinder 21, respectively.

That is, annular ridge 37 slidably contacts the forward end beyond inward step 40, where annular ridge 38 fits into annular groove 41. Rear end knob 39 slidably contacts the rear end of outer cylinder 21.

Cap 28 detachably covers front end 21A of outer cylinder 21; as an example, annular ridge 43 formed on a circumference of front end 21A of outer cylinder 21 that fits into annular groove 44 formed on the inside of cap 28.

The conventional example described above is operated as follows. An operator removes cap 28 from outer cylinder 21, and rotates rear end knob 39 relative to outer cylinder 21 to rotate screw shaft 36. Rotation of screw shaft 36 axially moves stick-shaped piece holder 24 having internal screw-thread 35 engaged therewith and stick-shaped piece 23 retained by stick-shaped piece holder 24 with key 29 of outer cylinder 21 fitted in keyway 30 of stick-shaped piece holder 24. Stick-shaped piece 23 thus is projected out of front end 21A of outer cylinder 21 for use by applying to a portion to be corrected.

To retract stick-shaped piece 23, rear end knob 39 is reversely rotated be rotate screw shaft 36 together in the same direction. Rotation of screw shaft 36 axially moves stick-shaped piece holder 24 having internal screw-thread 35 engaged with screw shaft 36 and stick-shaped piece 23 retained by stick-shaped piece holder 24 in the opposite axial direction to the one above with key 29 of outer cylinder 21 fitted in keyway 30 of stick-shaped piece holder 24, thereby retracting stick-shaped piece 23 into enter cylinder 21.

After stick-shaped piece 23 is withdrawn, the operator covers outer cylinder 21 with cap 28 on front end 21A.

If stick-shaped piece 23 is completely consumed, rear end knob 39 is rotated until stick-shaped piece holder 24 reaches its farthest extended position. Any remaining residual stick-shaped piece 23 is then removed from stick-shaped piece holder 24 before inserting a new stick-shaped piece into stick-shaped piece holder 24. After this, rotation of rear end knob 39 is reversed to retract stick-shaped piece holder 24 with stick-shaped piece 23 into front end 21A of outer cylinder 21. This completes supplying of stick-shaped piece 23.

In the conventional example described above, in order to prevent stick-shaped piece 23 from drying and moisture from evaporating when not in use, inward step 40 is made with a felt material (not shown) adhered thereto to closely contact the sliding surface of screw shaft 36 facing it. However, such felt material has a disadvantage that it undergoes changes from recurring use due to sliding of screw shaft 36, resulting in poor elasticity. This means that the sealing ability of the felt material gradually deteriorates, so that it cannot prevent stick-shaped piece 23 from drying out by moisture evaporating. The felt material also has the disadvantage that it cannot be easily replaced in view of the construction once the conventional stick-shaped piece drive container has been assembled.

The conventional stick-shaped piece drive container has a further different disadvantage that the stick-shaped piece cannot be easily replaced. That is, the remaining residual stick-shaped piece 23 must be removed from stick-shaped piece holder 24 to supply a new stick-shaped piece 23, involving problems of unsanitary, time consuming labor. In fact, the container is generally disposed of in practical use after stick-shaped piece 23 is completely consumed.

SUMMARY OF THE INVENTION

In view of the foregoing, it is one object of the present invention to provide a stick-shaped piece drive container capable of fully preventing a stick-shaped piece from drying out by moisture evaporating.

A second object of the present invention is to provide a stick-shaped piece supplying cassette capable of supplying the stick-shaped piece to the stick-shaped piece drive container in a simple way while fully preventing the stick-shaped piece from drying out from moisture evaporating.

Briefly, the foregoing objects are accomplished in accordance with aspects of the present invention by a stick-shaped piece drive container and stick-shaped piece supplying cassette. The stick-shaped piece drive container comprises an outer cylinder; a screw shaft having a helical groove provided on a circumference thereof and a connecting portion provided on a front end thereof, and being inserted in the outer cylinder so it is axially movable but not rotatable. An inner cylinder having a projection provided on a rear inside thereof fits in the helical groove, and is immovably mounted in the outer cylinder so it may axially rotate and extend out a forward end. A stick-shaped piece holder is coupled to the connecting portion of the screw shaft and slidably disposed in the inner cylinder for holding the stick-shaped piece. A cap detachably fits the inner cylinder or the outer cylinder or both. Sealing means is provided on a circumference of the stick-shaped piece holder for closely fitting the inside of the inner cylinder.

The stick-shaped piece supplying cassette is comprised of a stick-shaped piece holder adapted to be coupled with a stick-shaped piece drive container for holding a stick-shaped piece; a casing for removably covering the stick-shaped piece holder; and a sealing member provided on a circumference of the stick-shaped piece holder for sealing the inside of the casing.

The sealing member may be a sealing ring mounted on the circumference of the stick-shaped piece holder. Alternatively, the stick-shaped piece holder may be formed of elastomer resin, and the sealing member may be one of the annular projections formed on the circumference of the stick-shaped piece holder.

Further, the stick-shaped piece holder may have a partition plate for dividing the inside of the stick-shaped piece holder, and the projection may be formed outside on an elongation of the partition plate.

If the inner cylinder is rotated relative to the outer cylinder, the screw shaft and the stick-shaped piece holder coupled with the connecting portion of the screw shaft are moved through the inner cylinder in an axial direction as the projection of the inner cylinder fits into the screw groove of the screw shaft and the screw shaft unrotatably fits into the outer cylinder but is moveable in an axial direction. Thus, the stick-shaped piece retained by the stick-shaped piece holder is extended out of or retracted into the front end of the inner cylinder as the inner cylinder is rotated.

The sealing member provided on the circumference of the stick-shaped piece holder closely fits the inside of the inner cylinder to prevent the stick-shaped piece from drying out from evaporating moisture in cooperation with the cap when not in use.

To supply the stick-shaped piece to the container, the stick-shaped piece holder with the residual stick-shaped piece is detached and a new stick-shaped piece holder with a new stick-shaped piece is taken out with the stick-shaped supplying cassette. The stick-shaped piece holder is then coupled with the connecting portion of the stick-shaped drive container. These procedures allow a stick-shaped piece to be easily supplied in a short time without removal of the remaining residual stick-shaped piece and without staining the hands. The sealing member provided on the circumference of the stick-shaped piece holder to closely seal the casing prevents the stick-shaped piece from drying out from evaporating moisture in the stick-shaped piece supplying cassette. After the stick-shaped piece holder is coupled with the stick-shaped piece drive container, the sealing member serves as a sealing means for the inside of the inner cylinder of the stick-shaped drive container. The sealing member thus is in common use, thereby reducing the number of parts. The common use of the sealing member allows the sealing member to be replaced every time a new stick-shaped piece is supplied. The sealing ability of the sealing member is free of adverse effect by the deterioration due to the changes from recurring use.

Other objects and advantages of the invention will become more apparent from the following portion of this specification and from the accompanying drawings.

DESCRIPTION OF THE PREFERRED EMBODIMENTS

Figure 1:
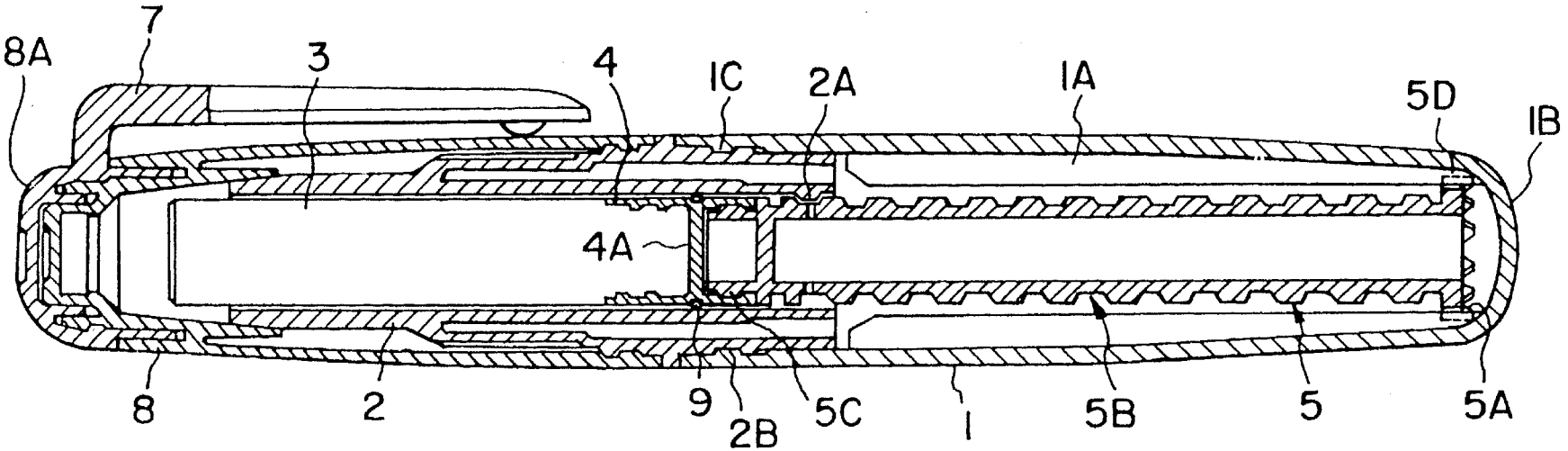
FIG. 1 is a longitudinal cross-sectioned view of a first embodiment of the stick-shaped piece drive container according to the present invention, FIG. 2(*a*) is an enlarged longitudinal cross-sectioned side view of the stick-shaped piece holder, FIG. 2(*b*) is a cross-sectional view looking in the direction of the arrow in FIG. 2(*a*), FIG. 3(*a*) is an enlarged longitudinal cross-sectioned side view of a second embodiment of a stick-shaped piece holder of the present invention, FIG. 3(*b*) is a cross-sectional view looking in the direction of the arrow in FIG. 3(*a*)

The following describes the embodiments of the present invention by reference to the accompanying drawings. FIG. 1 depicts a longitudinal cross-sectioned view of a first embodiment of the stick-shaped piece drive container according to the present invention.

First, the construction of outer cylinder 1 is described below. As shown in FIG. 1, the stick-shaped piece drive container has outer cylinder 1 having bottom 1B. Screw shaft 5 embedded in outer cylinder 1 cannot rotate, but can freely move in an axial direction. Screw shaft 5 has guide portion 5A integrated with its rear end in the embodiment shown for ease of assembly and to reduce the number of parts. Guide portion 5A has several keyways 5D provided on its periphery and outer cylinder 1 has mating elongated keys 1A provided on its inside surface in its axial direction opposite keyways 5D. Keyways 5D and keys may be reversed in position from each other on screw shaft 5 and outer cylinder 1 if desired.

Screw shaft 5 has helical groove 5B formed on its circumference, and has connecting portion 5C formed on its front.

Inner cylinder 2 is rotatably mounted in the front of outer cylinder 1, inner cylinder 2 being immovable in an axial direction. That is, inner cylinder 2 has annular groove 2B formed on its circumference which fits with step 1C formed on an inside surface of outer cylinder 1. Inner cylinder 2 further has projection 2A formed on its inside surface which fits with helical groove 5B of screw shaft 5.

Cap 8 is detachably mounted on the circumference of outer cylinder 1 or inner cylinder 2 (in the embodiment shown) or the circumferences of both. Cap 8 has front end 8A pressed on the head-thereof with integrated clip 7.

Figure 2A:
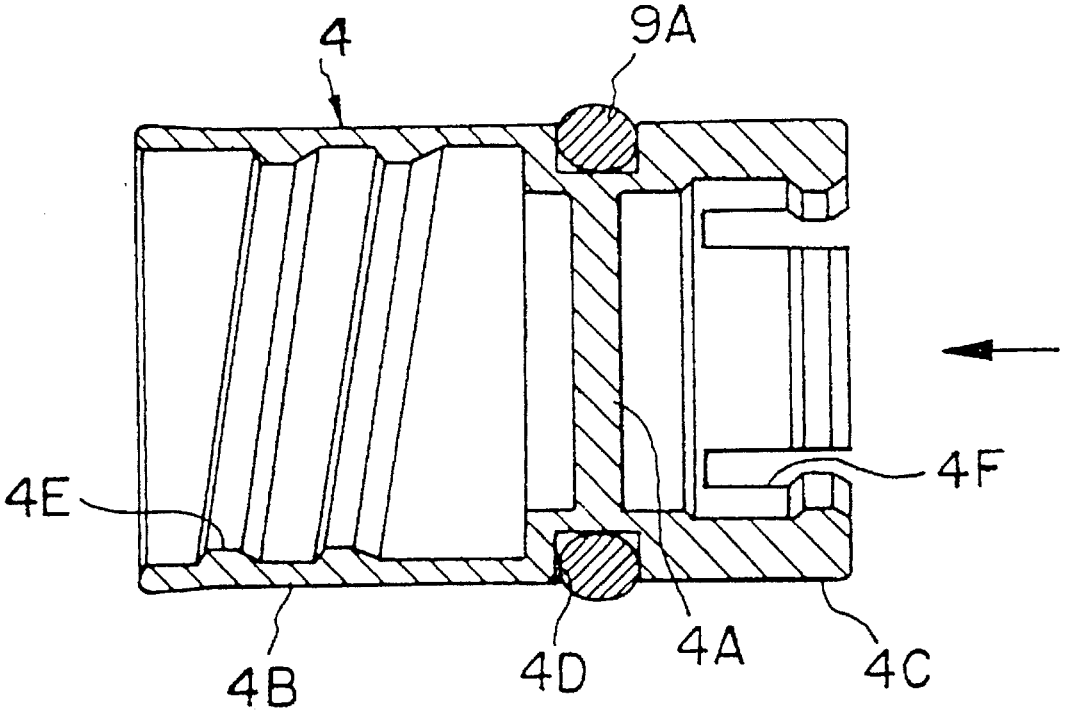
Figure 2B:
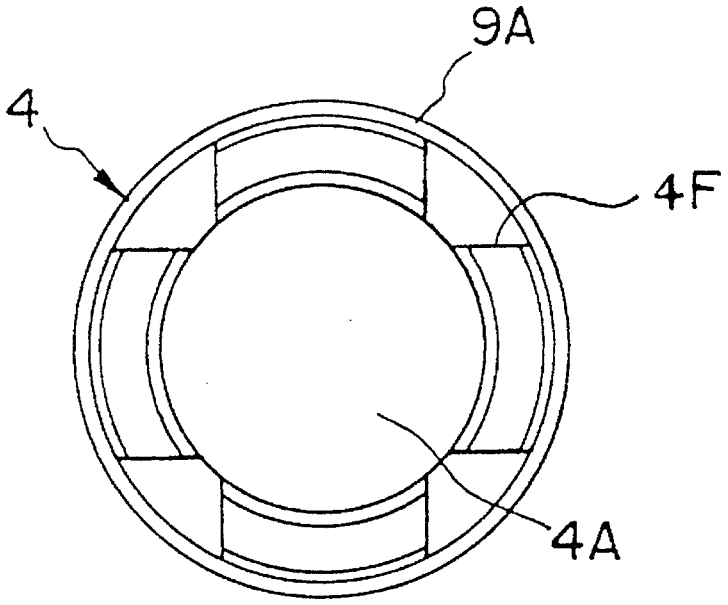

Connecting portion 5C of screw shaft 5 is detachably coupled to stick-shaped piece holder 4 and is embedded in inner cylinder 2. FIGS. 2(*a*) and (*b*) are enlarged views of stick-shaped piece holder 4. FIG. 2(*a*) is a longitudinal cross-sectioned side view of stick-shaped piece holder 4 while FIG. 2(*b*) is a cross-sectional view looking in the direction of the arrow in FIG. 2(*a*). Stick-shaped piece holder 4 is divided into stick-shaped holding portion 4B and screw shaft coupling portion 4C by partition plate 4A formed therein. Stick-shaped holding portion 4B has internal screw-thread 4E to hold stick-shaped piece 3 in position. Screw shaft coupling portion 4C, on the other hand, has four slots 4F on its circumference to provide elasticity to allow screw shaft coupling portion 4C to expand outward. This allows screw shaft coupling portion 4C to be easily coupled with connecting portion 5C as it can expand outward.

Screw shaft coupling portion 4C has annular groove 4D formed on its circumference to receive a sealing ring 9A that fits therein. Sealing ring 9A is larger than the circumference surface of stick-shaped piece holder 4, but compressed by the inside of inner cylinder 2 to closely fit the inside.

In turn, an operation of the first embodiment constructed as described above is described below.

In operation, with cap 8 removed from inner cylinder 2 and inner cylinder 2 rotated relative to outer cylinder 1 or outer cylinder 1 rotated relative to inner cylinder 2, stick-shaped piece holder 4 coupled with screw shaft 5 at connecting portion 5C moves in an axial direction. Projection 2A will then move along helical groove 5B because projection 2A of inner cylinder 2 fits into helical groove 5B of screw shaft 5 and because key 1A of outer cylinder 1 fits keyway 5D of guide portion 5A. Stick-shaped piece 3 retained by stick-shaped piece holder 4 is extended from the front end of inner cylinder 2 for use.

When retracting stick-shaped piece 3, an operator reverses the rotation of outer cylinder 1 or inner cylinder 2. Projection 2A then moves along screw groove 5B in the opposite direction and at the same time, stick-shaped piece holder 4 connected with screw shaft 5 at connecting portion 5C moves in the opposite direction. Stick-shaped piece 3 held by stick-shaped piece holder 4 is retracted into the front end of inner cylinder 2.

When the container is not in use, evaporation of moisture of stick-shaped piece 3 can be prevented by the close contact of the periphery portion of inner cylinder 2 with the inside of cap 8 and by close contact of a portion of sealing ring 9*a* provided on the circumference of stick-shaped piece holder 4 with inner cylinder 2. This can keep stick-shaped piece 3 from drying over a long period.

In addition, sealing ring 9A provides frictional resistance between the inside of inner cylinder 2 and stick-shaped piece holder 4. The friction prevents rotation of stick-shaped piece holder 4 that might be caused by a torque on stick-shaped piece 3 when in use. This overcomes the historical problem of idle rotation of stick-shaped piece holder 4 and stick-shaped piece 3 in use conventionally associated with the lower resistance of stick-shaped piece 3 with inner cylinder 2 when stick-shaped piece 3 becomes short.

Figure 3A:
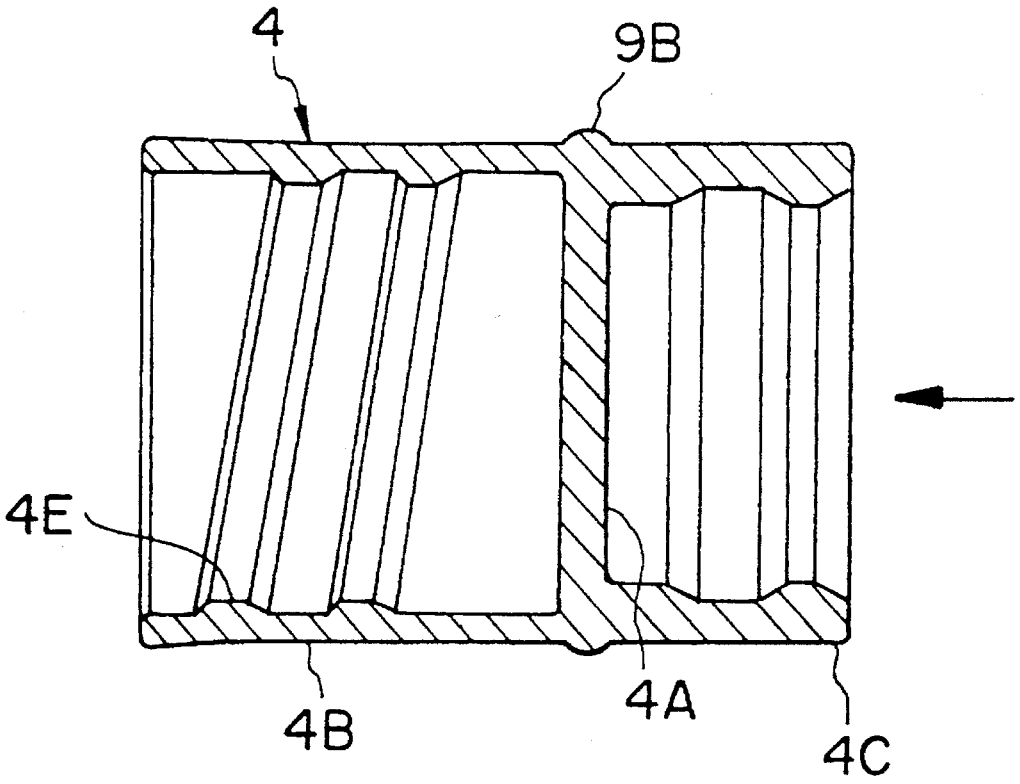
Figure 3B:
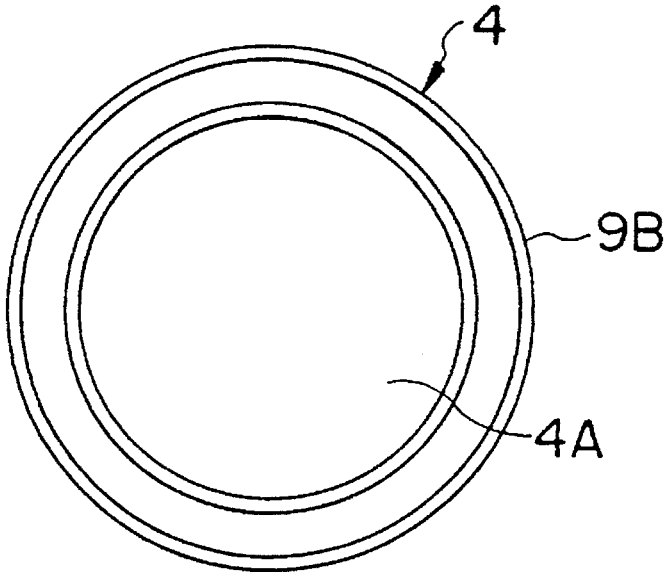

In turn, FIGS. 3(*a*) and (*b*) depict a second embodiment of sealing member 9 of the present invention. In this second embodiment, stick-shaped piece holder 4 is formed of an elastomer resin. The elastomer resins available include olefine resins such as, for example, thermoplastic elastomer commercially available and registered as "Santoprene". Further annular projection 9B is integrated into the outside as an elongation of partition plate 4A of stick-shaped piece holder 4.

As described above, even with the use of such stick-shaped piece holder 4, elastic projection 9B close fits the inside of inner cylinder 2, thereby providing the same effect as with the first embodiment. Projection 9B also provides the advantage of allowing use of the elasticity of partition plate 4A provided in the elongated direction of partition plate 4A. Projection 9B further provides the additional advantage of reducing the number of parts by being integrated with stick-shaped piece holder 4.

To form stick-shaped piece holder 4, it can be struck from a mold because of its entire elasticity without using a split-mold nevertheless projection 9B protrudes out from the body of holder 4. This provides the advantage of easy fabrication of stick-shaped piece holder 4. In addition, stick-shaped piece holder 4 does not need the special slots 4F shown in FIG. 2 because screw shaft coupling portion 4*c* itself is so elastic that it will easily couple with connecting portion 5C of screw shaft 5.

Figure 4:
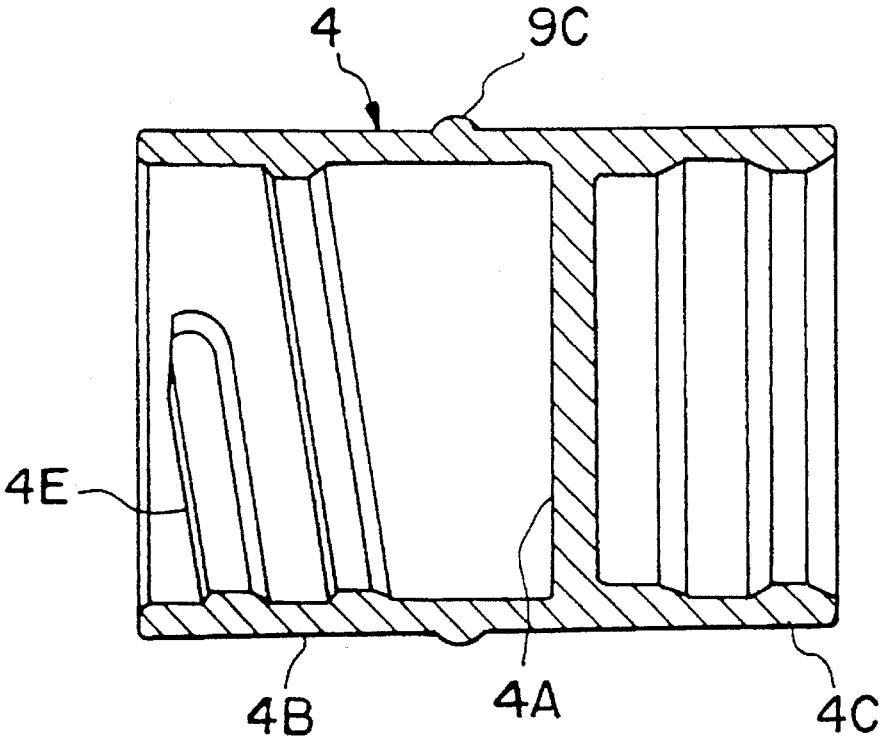
FIG. 4 is an enlarged longitudinal cross-sectioned view of a third embodiment of a stick-shaped piece holder of the present invention.

In turn, FIG. 4 depicts a third embodiment of the present invention. The third embodiment has projection 9C, instead of projection 9B as shown in FIG. 3, provided on the circumference of stick-shaped piece holder 4 of the stick-shaped holding portion 4B rather than as an extension of partition plate 4A. This construction provides the same effect as sealing ring 9A or projection 9B shown in FIGS. 2 and 3.

Figure 5:
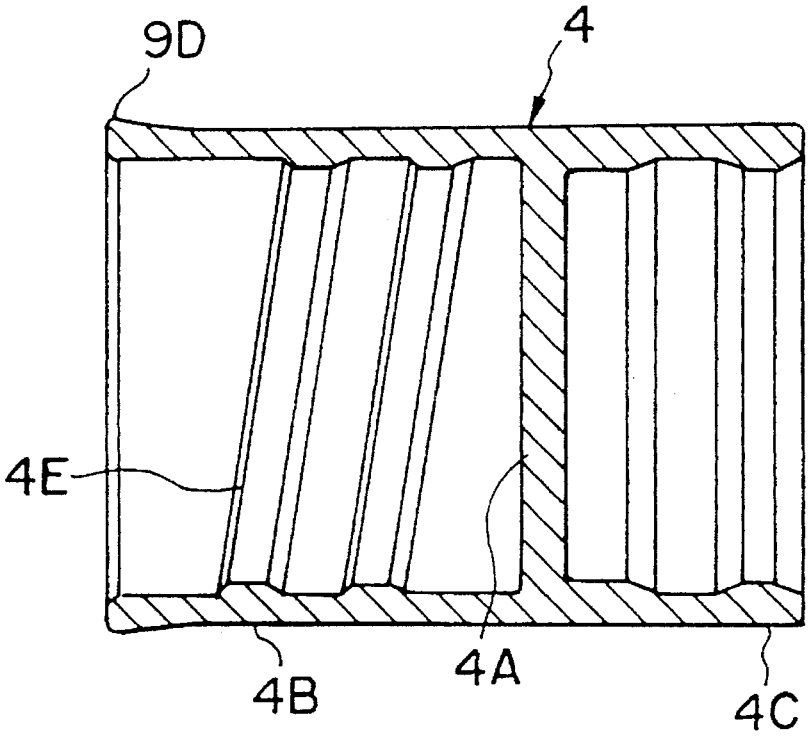
FIG. 5 is an enlarged longitudinal cross-sectioned view of a fourth embodiment of a stick-shaped piece holder of the present invention.

FIG. 5 depicts a fourth embodiment of the present invention. The fourth embodiment has projection 9D formed thicker portion on the outward end of stick-shaped holding portion 4B of stick-shaped piece holder 4 instead of projection 9B and projection 9C in FIGS. 3 and 4. This construction provides the same effect as sealing ring 9A or projections 9B and 9C in FIGS. 2, 3, and 4 respectively. In addition, stick-shaped piece holder 4 can be more easily removed from a mold in production. This construction also provides another beneficial effects. Projection 9D prevents solution forming the stick-shaped piece material from leaking out of a clearance between a cylinder and stick-shaped piece holder 4 when stick-shaped piece 3 is typically formed by a solution filling and solidified in stick-shaped piece holder 4 in the cylinder.

Figure 6:
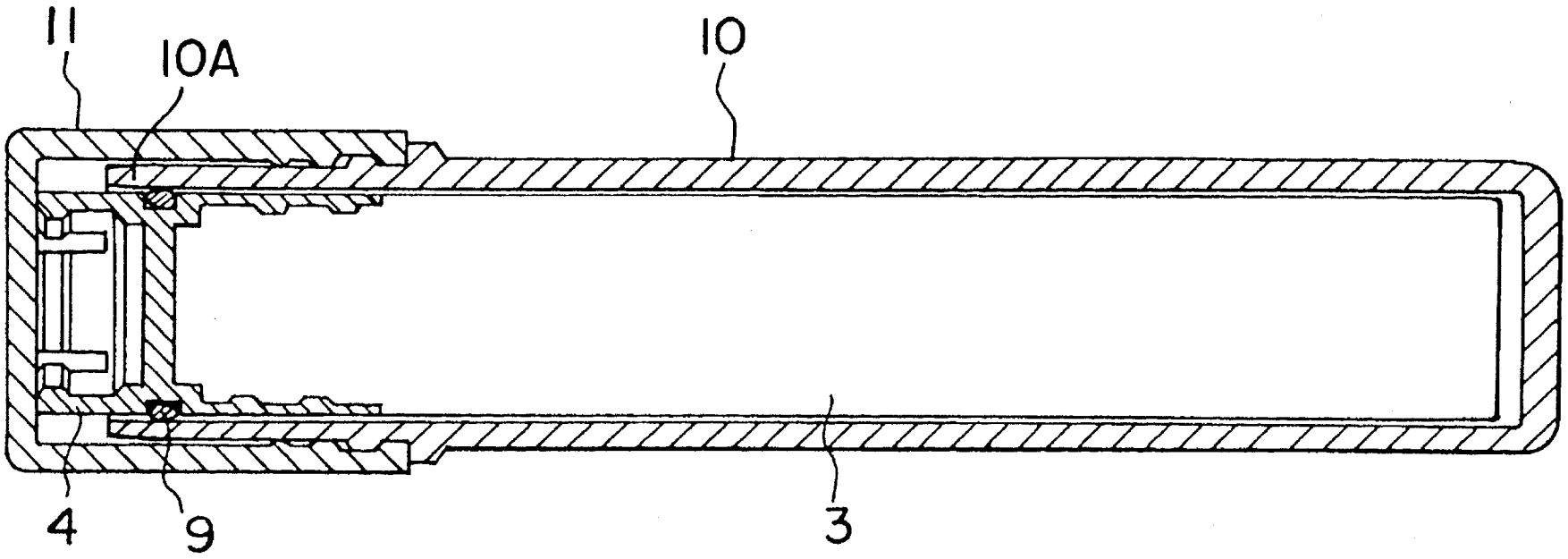
FIG. 6 is a longitudinal cross-sectioned view of an embodiment of a stick-shaped piece supplying cassette of the present invention.
Figure 7:
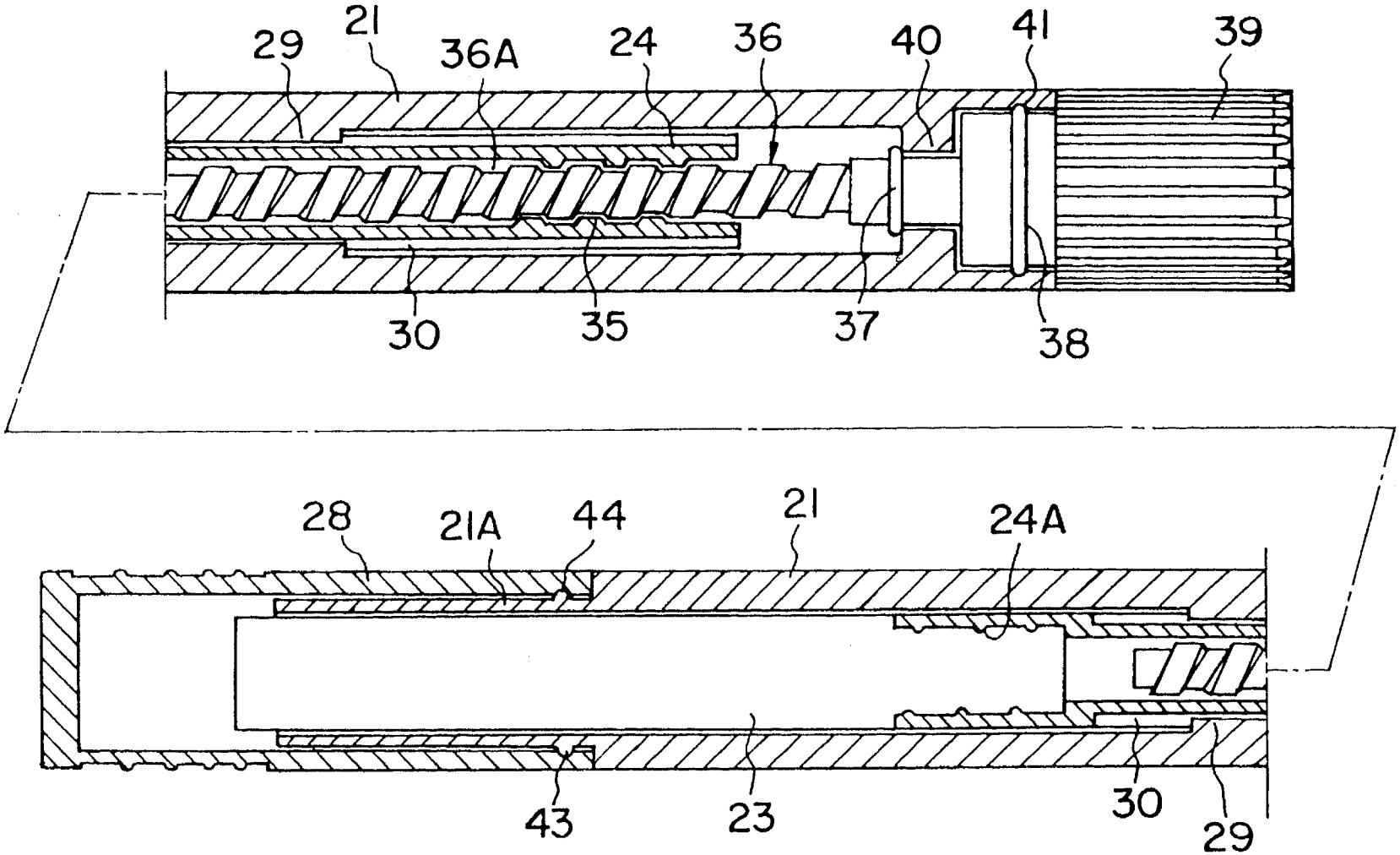
FIG. 7 PRIOR ART
FIG. 7 is a longitudinal cross-sectional view of the construction of one example of a conventional stick-shaped piece drive container.

In turn, FIG. 6 depicts one embodiment of the stick-shaped piece supplying cassette of the present invention. The stick-shaped piece supplying cassette is comprised of casing 10 containing stick-shaped piece 3 and stick-shaped piece holder 4 and cover 11 detachably mounted on casing 10. Casing 10 has taper 10A on an inside end thereof to facilitate loading stick-shaped piece 3 and stick-shaped piece holder 4. Stick-shaped piece holder 4 has a close-filling member (sealing ring 9A in the figure) provided on the circumference thereof to tightly fit against the inside of casing 10, thereby preventing stick-shaped piece 3 from drying out by evaporating moisture.

The following describes procedures for supplying stick-shaped piece holder 4 into a stick-shaped piece drive container using the stick-shaped piece supplying cassette.

If stick-shaped piece 3 is completely used up in the stick-shaped piece drive container, the operator pulls stick-shaped piece holder 4 with the remaining stick-shaped piece 3 out of connecting portion 5C. He then prepares a new stick-shaped piece supplying cassette by removing cover 11 before coupling the new stick-shaped piece holder 4 with connecting portion 5C, and rotates inner cylinder 2 to retract new stick-shaped piece holder 4 coupled with screw shaft 5 inward. These procedures allow pulling time stick-shaped piece out of casing 10 and replacing it in inner cylinder 2 without contaminating the hands. In these procedures, sealing member 9 provided on the circumference of stick-shaped piece holder 4 keeps stick-shaped piece holder 4 and stick-shaped piece 3 from dropping out of the cassette, or prevents careless failure of supplying, because of the friction resistance between sealing member 9 and casing 10 even if the stick-shaped supplying cassette is pointed downward with stick-shaped piece holder 4 turned down, and cover 11 removed.

As described so far, with the use of the stick-shaped piece drive container and the stick-shaped piece supplying cassette, stick-shaped piece holder 4 and sealing member 9 effectively prevent the stick-shaped piece from drying from evaporating moisture as they can be used in common. By the common use of stick-shaped piece holder 4 and sealing member 9, sealing ability of sealing member 9 does not deteriorate due to its periodic use as sealing member 9 also is replaced every time stick-shaped piece 3 is replaced.

As described above, the present invention effectively provides a sealing member on the circumference of the stick-shaped piece holder for retaining the stick-shaped piece making the stick-shaped piece holder detachable, can prevent the stick-shaped piece in a stick-shaped piece drive container and a stick-shaped piece supplying cassette from drying out by evaporating moisture.

Also, the present invention provides the advantage that some part are in common use for the stick-shaped piece drive container and stick-shaped piece supplying cassette.

Further, the present invention effectively provides a stick-shaped piece that can be easily supplied to the stick-shaped piece drive container from the stick-shaped piece supplying cassette.

While the principles of the invention have been described above in connection with specific embodiments, and particular modifications thereof, it is to be clearly understood that this description is given only by way of example and not as a limitation on the scope of invention.

What is claimed is:

1. A stick-shaped piece drive container comprising;

an outer cylinder;

a screw shaft having a helical groove provided on a circumference thereof and a connecting portion provided on a front end thereof, said screw shaft being unrotatably inserted in said outer cylinder but movably in an axial direction thereof;

an inner cylinder having a projection provided on a rear inside thereof engaging said helical groove, said inner cylinder being immovably mounted in said outer cylinder but rotatably in an axial direction thereof and extending forwardly out of said outer cylinder;

a cylindrical elastomer resin stick-shaped piece holder for a stick-shaped piece slidably disposed in said inner cylinder, having a partition plate dividing the inside of said stick-shaped piece holder into a cylindrical connecting portion and a cylindrical holding portion; said screw shaft being detachably coupled to said cylindrical connecting portion;

said cylindrical connecting portion of said stick-shaped piece holder having an inlet that is smaller in diameter then said screw shaft and having an elasticity so that said screw shaft expands said cylindrical connecting portion when it is connected to securely hold said screw shaft and prevent accidental detachment;

a cap detachably fitting around said inner cylinder;

annular projecting sealing means integrally formed on an outside circumference of said stick-shaped piece holder for sealing between the circumference of said stick-shaped piece holder and the inside of said inner cylinder;

said annular projecting sealing means slidably engaging the interior of said inner cylinder;

whereby a stick-shaped piece of material in said stick-shaped piece holder is prevented from drying out.

2. The stick-shaped piece container according to claim 1 wherein said annular projecting sealing means is formed on the outside of said stick-shaped holder by an elongation of said partition plate.

3. The stick-shaped piece container according to claim 1 wherein said annular projecting sealing means comprises a thicker portion on an outside front end portion of said stick-shaped piece holder.

4. A drive container for extending or retracting a stick-shaped piece comprising;

an outer cylinder;

an axially movable screw shaft inserted in said outer cylinder, said screw shaft having a helical groove and a connecting portion;

an inner cylinder rotatably mounted on said outer cylinder, a portion of said inner cylinder extending beyond a forward end of said outer cylinder;

projecting means on an inside surface of said inner cylinder for engaging said helical groove of said screw shaft;

a portion of said inner cylinder having a pair of divergent concentric tubular sections, said projection engaging the helical groove being on an inner surface of the innermost of said pair of divergent concentric sections, the outermost of said pair of divergent concentric tubular sections engaging said outer cylinder;

a cylindrical elastomer resin stick-shaped piece holder for holding a stick-shaped piece slidably disposed in said inner cylinder having a partition plate dividing the inside of said stick-shaped piece holder into a cylindrical connecting portion and a cylindrical holding portion; said screw shaft being detachably coupled to said cylindrical connecting portion;

said cylindrical connecting portion; of said stick-shaped piece holder having an inlet that is smaller in diameter then said screw shaft and having an elasticity so that said screw shaft expands said cylindrical connecting portion when it is connected to securely hold said screw shaft and prevent accidental detachment;

cap means detachably secured on said inner cylinder;

annular projecting sealing means integrally formed on an outside circumference of said stick-shaped piece holder for sealing between the circumference of said stick-shaped piece holder and the inside of said inner cylinder;

said annular projecting sealing means slidably engaging the interior of said inner cylinder;

whereby a stick-shaped piece of material in said stick-shaped piece holder is prevented from drying out.

5. The container according to claim 4 wherein said annular projecting sealing means comprises a compressible projecting annular ridge formed on an outside surface of said stick-shaped piece holder.

6. The container according to claim 5 wherein said compressible projecting ridge is coextensively formed with said partition plate.

7. The container according to claim 5 wherein said compressible projecting annular ridge is being formed on an outside surface of a forward section of said stick-shaped holder.

8. The container according to claim 5 wherein said compressible projecting annular ridge is a thickened portion on a forward end of said stick-shaped piece holder.

9. A stick-shaped piece supplying cassette comprising;

an elastomer resin stick-shaped piece holder for holding a stick-shaped piece having a partition plate dividing the inside of said stick-shaped piece holder into a cylindrical connecting portion for coupling with a screw shaft and a holding portion for holding a stick-shaped piece;

a casing for removably covering said stick-shaped piece holder;

said cylindrical connecting portion having an inlet constructed to expand for forcibly receiving a screw shaft having an outer diameter larger than said inlet to securely retain said screw shaft in said cylindrical connecting portion;

an annular projecting sealing means integrally formed on a circumference of said stick-shaped piece holder for sealing with the inside of said casing;

said annular projecting sealing means slidably on interior surface of said casing;

whereby said stick-shaped holder is retained and sealed in said casing by annular projecting sealing means compressibly engaging the inside of said casing to frictionally retain and seal around said stick-shaped piece holder.

10. The stick-shaped piece supplying cassette according to claim 9, wherein said annular projecting sealing means is formed on the outside by an elongation of said partition plate.

11. The stick-shaped piece supplying cassette according to claim 9 of said stick-shaped piece holder, wherein said annular projecting sealing means is formed as a thicker portion on the outside of the front end of said stick-shaped piece holder.

12. A storage supply cassette for a stick-shaped piece of material comprising;

a casing;

an elastomer resin stick-shaped piece holder for holding a stick-shaped piece of material having a partition plate dividing the inside of said stick-shaped piece holder into a cylindrical connecting portion for coupling with a screw shaft and a holding portion for holding a stick-shaped piece;

said cylindrical connecting portion constructed to have an expanding inlet for forcibly receiving said screw shaft having an outer diameter larger than said inlet to securely retain said screw shaft in said cylindrical connecting portion;

retaining means for retaining said stick-shaped piece holder with stick-shaped piece of material in said casing;

said retaining means including annular projecting sealing means on the circumference of said stick-shaped piece holder for sealing and retaining said stick-shaped piece holder with said stick-shaped piece of material in said casing;

said sealing means comprising an integral compressible projecting annular ridge on an outside circumferential surface of said stick-shaped holder;

said sealing means slidably engaging an interior surface of said casing;

whereby said stick-shaped holder is retained and sealed in said casing by said compressible projecting annular ridge compressibly engaging the inside of said casing to frictionally retain and seal around said stick-shaped piece holder.

13. The cassette according to claim 12 wherein said compressible projecting annular ridge is formed coextensively with said partition plate.

14. The cassette according to claim 12 wherein said compressible projecting annular ridge is formed on an outside surface of the forward section of said stick-shaped holder.

15. The cassette according to claim 12 wherein said compressible projecting annular ridge is a thickened portion of a forward end of said stick-shaped piece holder.

* * * * *